US008297576B2

(12) United States Patent
McLeod

(10) Patent No.: US 8,297,576 B2
(45) Date of Patent: Oct. 30, 2012

(54) FIXTURE MOUNTING BRACKET ASSEMBLY

(75) Inventor: Sebastian C. McLeod, Parkville, MO (US)

(73) Assignee: McLeod Nine, Kansas City, MO (US)

( * ) Notice: Subject to any disclaimer, the term of this patent is extended or adjusted under 35 U.S.C. 154(b) by 204 days.

(21) Appl. No.: 12/555,963

(22) Filed: Sep. 9, 2009

(65) Prior Publication Data

US 2010/0059642 A1 Mar. 11, 2010

Related U.S. Application Data

(60) Provisional application No. 61/095,391, filed on Sep. 9, 2008, provisional application No. 61/120,345, filed on Feb. 3, 2009, provisional application No. 61/103,068, filed on Mar. 2, 2009.

(51) Int. Cl.
*A47H 1/14* (2006.01)

(52) U.S. Cl. ..... 248/257; 248/262; 248/251

(58) Field of Classification Search ..... 248/261, 248/262, 265, 216.1, 218.3, 241, 251, 214, 248/205.1, 257, 258, 346.03, 218.2, 216.4, 248/217.4, 254, 256, 267
See application file for complete search history.

(56) References Cited

U.S. PATENT DOCUMENTS

| | | | | | |
|---|---|---|---|---|---|
| 368,740 | A | * | 8/1887 | Trimble | 248/254 |
| 375,585 | A | * | 12/1887 | Trimble | 248/254 |
| 434,714 | A | * | 8/1890 | Juenemann | 248/267 |
| 440,899 | A | * | 11/1890 | Peden | 248/267 |
| 549,046 | A | * | 10/1895 | Baker | 248/265 |
| 562,257 | A | * | 6/1896 | Pinckney | 248/254 |
| 562,910 | A | * | 6/1896 | Spencer | 248/257 |
| 638,826 | A | * | 12/1899 | Wilderson | 248/257 |
| 658,551 | A | | 9/1900 | Lord | |
| 758,098 | A | * | 4/1904 | Nordling | 248/257 |
| 758,216 | A | | 4/1904 | Reiss et al. | |
| 915,598 | A | | 3/1909 | Hess, Jr. | |
| 919,988 | A | * | 4/1909 | Witzal | 248/254 |
| 1,090,105 | A | * | 3/1914 | Monk | 248/254 |
| 1,119,695 | A | * | 12/1914 | Hatch | 248/261 |
| 1,189,763 | A | * | 7/1916 | White | 160/108 |
| 1,242,345 | A | * | 10/1917 | Grimm | 248/258 |
| 1,248,363 | A | * | 11/1917 | Malcomson et al. | 248/489 |
| 1,271,994 | A | * | 7/1918 | Barlow | 248/103 |
| 1,315,553 | A | * | 9/1919 | Holm | 160/370 |
| 1,341,742 | A | | 6/1920 | Fisher | |
| 1,342,230 | A | * | 6/1920 | Ruzicka | 248/254 |
| 1,355,974 | A | * | 10/1920 | Holm | 248/256 |
| 1,391,528 | A | | 9/1921 | Cranford | |

(Continued)

FOREIGN PATENT DOCUMENTS

JP 2005073831 A 3/2005

OTHER PUBLICATIONS http://www.ezcurtainrodbrackets.com/.

(Continued)

*Primary Examiner* — Bradley Duckworth
(74) *Attorney, Agent, or Firm* — Pearne & Gordon LLP

(57) ABSTRACT

A fixture mounting bracket assembly is strong, easy to install, self-leveling, adjustable in multiple directions, and removable so that it results in little or no visible damage when removed from the wall. The fixture mounting bracket assembly includes a base assembly, an elbow, and a fixture support assembly.

22 Claims, 6 Drawing Sheets

U.S. PATENT DOCUMENTS

| | | | | | |
|---|---|---|---|---|---|
| 1,392,602 | A | | 10/1921 | Rosencranz | |
| 1,506,730 | A | | 8/1924 | Witteman | |
| 1,537,497 | A | | 5/1925 | Rains | |
| 1,567,744 | A | * | 12/1925 | Mathis | 248/256 |
| 1,573,260 | A | | 2/1926 | Luke | |
| 1,664,370 | A | * | 3/1928 | Milburn et al. | 52/678 |
| 1,712,834 | A | * | 5/1929 | McClure | 248/256 |
| 1,751,126 | A | | 3/1930 | Bunker | |
| 2,015,280 | A | * | 9/1935 | Morishita | 248/451 |
| 2,033,109 | A | * | 3/1936 | Blunt | 248/251 |
| 2,049,716 | A | * | 8/1936 | Owen | 248/549 |
| 2,079,816 | A | | 5/1937 | Rose | |
| 2,185,385 | A | | 1/1940 | Rose | |
| 2,229,904 | A | * | 1/1941 | Sliwa | 211/105.2 |
| 2,274,242 | A | | 2/1942 | Lipski | |
| 2,470,694 | A | * | 5/1949 | Foo | 248/106 |
| 2,848,184 | A | | 8/1958 | Kennedy | |
| 2,927,762 | A | | 3/1960 | Owsiak | |
| 2,998,955 | A | | 9/1961 | Hertzog | |
| 3,104,086 | A | | 9/1963 | Salzman | |
| 3,218,017 | A | | 11/1965 | Butler | |
| 3,433,449 | A | * | 3/1969 | Musante | 248/497 |
| 3,774,522 | A | | 11/1973 | Marsh | |
| 3,818,543 | A | | 6/1974 | Baker, Sr. | |
| 4,120,474 | A | | 10/1978 | Hurley | |
| 4,140,294 | A | * | 2/1979 | Zwarts | 248/265 |
| 4,179,091 | A | * | 12/1979 | Bidney | 248/265 |
| 4,283,034 | A | | 8/1981 | Sheehan | |
| 4,284,258 | A | | 8/1981 | Kleiman | |
| 4,288,057 | A | | 9/1981 | Sainsbury, Jr. | |
| 4,299,369 | A | | 11/1981 | Colich, Sr. | |
| 4,335,865 | A | | 6/1982 | Cormier | |
| 4,411,401 | A | | 10/1983 | Anderson | |
| 4,848,432 | A | | 7/1989 | Connolly | |
| 4,971,865 | A | | 11/1990 | Nowlan | |
| 5,074,350 | A | | 12/1991 | Carter | |
| 5,127,459 | A | | 7/1992 | Markowitz | |
| 5,184,661 | A | | 2/1993 | Hannerstig | |
| 5,544,692 | A | | 8/1996 | McMichael | |
| 5,782,704 | A | * | 7/1998 | Tetler et al. | 473/282 |
| 5,825,289 | A | | 10/1998 | Riordan | |
| 5,979,848 | A | * | 11/1999 | Kuthy et al. | 248/261 |
| 6,186,457 | B1 | | 2/2001 | Carter | |
| 6,206,074 | B1 | | 3/2001 | Liu | |
| 6,213,437 | B1 | | 4/2001 | Robbins | |
| 6,279,863 | B1 | | 8/2001 | Hall | |
| 6,289,618 | B1 | | 9/2001 | Kump et al. | |
| 6,315,258 | B1 | | 11/2001 | Myler et al. | |
| 6,325,349 | B1 | | 12/2001 | Breaux | |
| 6,367,755 | B1 | | 4/2002 | Arena | |
| 6,398,174 | B1 | | 6/2002 | Emalfarb | |
| 6,431,247 | B1 | | 8/2002 | Harrison, Jr. et al. | |
| 6,471,177 | B1 | | 10/2002 | Emrick et al. | |
| 6,474,609 | B1 | | 11/2002 | Pinard | |
| 6,648,046 | B1 | | 11/2003 | Gibson | |
| 6,651,945 | B2 | * | 11/2003 | Rivellino et al. | 248/206.5 |
| 7,028,960 | B2 | | 4/2006 | Goldstein | |
| 7,287,734 | B2 | | 10/2007 | Bell | |
| 2002/0125387 | A1 | * | 9/2002 | Rivellino et al. | 248/216.1 |
| 2005/0017142 | A1 | | 1/2005 | Ogden | |
| 2005/0098272 | A1 | | 5/2005 | Rizzo | |
| 2005/0098697 | A1 | | 5/2005 | Collins | |
| 2005/0242265 | A1 | | 11/2005 | Huang | |
| 2006/0016946 | A1 | | 1/2006 | Bohlen | |
| 2006/0213625 | A1 | | 9/2006 | Nien et al. | |
| 2007/0290110 | A1 | | 12/2007 | West et al. | |
| 2008/0156952 | A1 | | 7/2008 | Nathan | |

OTHER PUBLICATIONS

Webpage printouts from www.expodesigninc.com/shelving-and-hardware/corner-shelf-kits.html, dated Jun. 19, 2012, for Corner Cable Shelves and Corner Clip Shelves, 5 pages.

Installation instructions download for "Corner Cable Shelf" from www.expodesigninc.com/downloads/pdf/CORNER_CABLE_SHELF.pdf, undated, 1 page.

Installation instructions download for "Corner Shelf Clip Instructions" from www.expodesigninc.com/downloads/pdf/CORNER_CLIP_SHELF.pdf, undated, 1 page.

* cited by examiner

FIXTURE MOUNTING BRACKET ASSEMBLY

CROSS-REFERENCE TO RELATED APPLICATIONS

The present application is a nonprovisional of and claims the benefit of U.S. Provisional Patent Application Ser. No. 61/095,391, filed Sep. 9, 2008; U.S. Provisional Patent Application No. 61/120,345, filed Feb. 3, 2009; and U.S. Provisional Patent Application No. 61/103,068, filed Mar. 2, 2009, which documents are incorporated herein by reference to the extent permitted by law.

BACKGROUND OF THE INVENTION

Brackets are often used to hang fixtures on walls. Hooks connected to a wall or ceiling directly or by a bracket can be used to hang pictures, curtain rods and curtains, towel rods, plants, light fixtures, decorations, and other fixtures. Brackets mounted to a wall or ceiling can be used to hold shelves, mount speakers, lights, soap dispensers, towel rods, curtain rods, decorations. Most existing brackets are mounted to a bare wall. As a result, if more than one bracket is required to mount a fixture, an installer has to precisely locate and install these brackets to ensure the fixture is level upon installation because most existing brackets do not allow an installer to fine tune the position of a fixture. Therefore, an installer must perform multiple measurements to position a bracket in the desired place on the wall making these brackets difficult to install correctly by the typical do-it-yourself user; moreover, it often requires multiple tries before the bracket is mounted in the desired location and often results in unwanted and unsightly extra holes in the wall. Further, most existing brackets used to mount fixtures are not adjustable and once installed, existing brackets do not allow an installer to adjust the height of the bracket or the distance away from the wall once the bracket has been coupled to the wall.

The connections of most existing fixture mounting brackets to the wall do not provide adequate strength or it is difficult for do-it-yourself installers to install wall anchors properly to support most fixtures. When the connection to the wall is inadequate, either the bracket pulls away from the wall thereby damaging the wall and requiring additional wall repair to remedy the damage and/or the fixture falls to the ground and is damaged. Even if the existing brackets are adequately connected to the wall, they leave visible holes in a wall that require patch work and painting to cover up when they are removed.

Therefore, a need exists in the art for a strong, easy to install, self-leveling, multi-direction adjustable, and removable fixture mounting bracket assembly that provides little or no visible damage to the wall.

BRIEF SUMMARY OF THE INVENTION

The present invention is generally directed to a fixture mounting bracket assembly that is strong, easy to install, self-leveling, adjustable in multiple directions, and removable that results in little or no visible damage to a wall when removed. The fixture mounting bracket assembly generally includes a base assembly, an elbow, and a fixture support assembly.

In certain embodiments, the present invention provides a method for mounting a fixture on a wall using the fixture mounting bracket assembly of the present invention. The method generally includes coupling a fixture mounting bracket assembly to a wall or other structure, adjusting the fixture mounting bracket assembly in more than one direction, fixing the fixture mounting bracket assembly in a desired configuration, and configuring a fixture to be supported by the fixture mounting bracket assembly.

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawing forms a part of the specification and is to be read in conjunction therewith, in which like reference numerals are employed to indicate like or similar parts in the various views, and wherein.

DETAILED DESCRIPTION OF THE INVENTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 1:
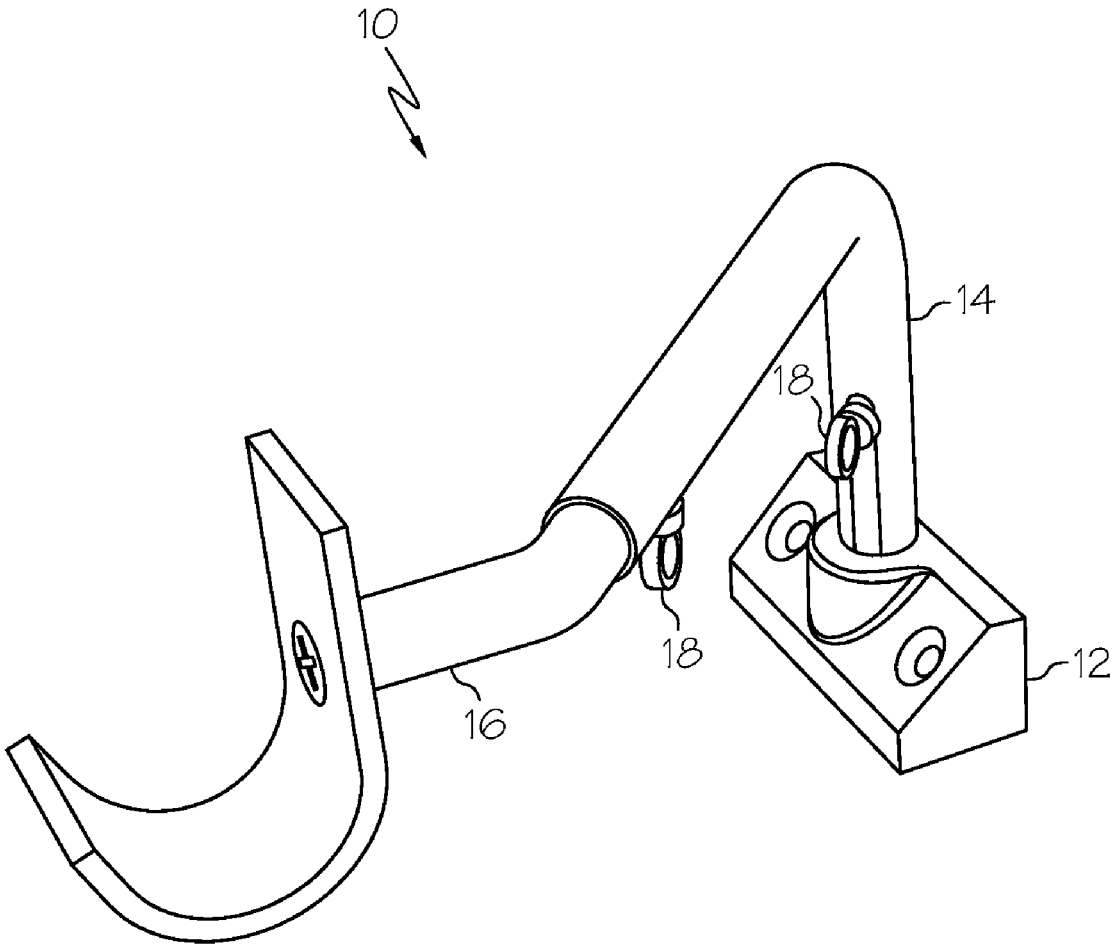
FIG. 1 is a top perspective view of a fixture mounting bracket assembly configured in accordance with certain embodiments of the present invention.

Turning now to the drawing figures, and particularly, FIG. 1, the present invention is directed to a fixture mounting bracket assembly 10 having a base assembly 12, an elbow 14, a fixture support assembly 16, and at least one adjustment mechanism 18. Generally, fixture mounting bracket assembly 10 can be adjusted to at least two vertical positions and at least two horizontal positions. Fixture mounting bracket assembly 10 is generally constructed of metal, molded or extruded plastic, plastic composite, wood, ceramic, any other suitable material known in the art, or combination thereof. The material used may be selected based on manufacturer- or user-specific requirements such as manufacturing efficiency, strength, durability, appearance, or environmental considerations. Further, fixture mounting bracket assembly 10 can be manufactured using any suitable manufacturing method known in the art for the material including, but not limited to, casting, machining, forging, deep drawing, punching, molding, press brake forming, die forming, extruding, stamping and/or joining. If required by the manufacturing method, coupling of components of fixture mounting bracket assembly 10 may be accomplished using any coupling means known in the art including, but not limited to, welds, screws, rivets, power actuated fasteners, pneumatic fasteners, bolts, nails, or adhesives.

Figure 2A:
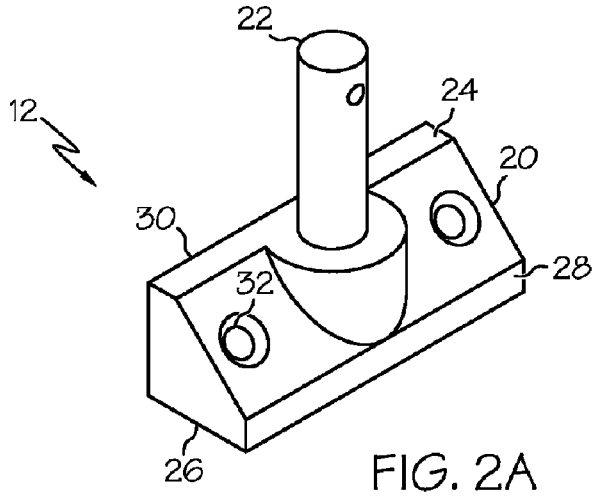
FIG. 2A is a top perspective view of a base assembly of the fixture mounting bracket assembly in accordance with certain embodiments of the present invention.
Figure 2B:
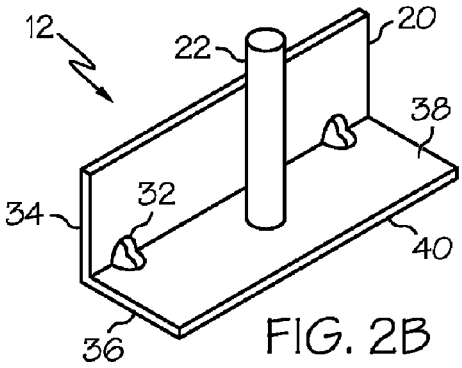
FIG. 2B is a top perspective view of a base assembly of the fixture mounting bracket assembly in accordance with certain embodiments of the present invention.
Figure 2C:
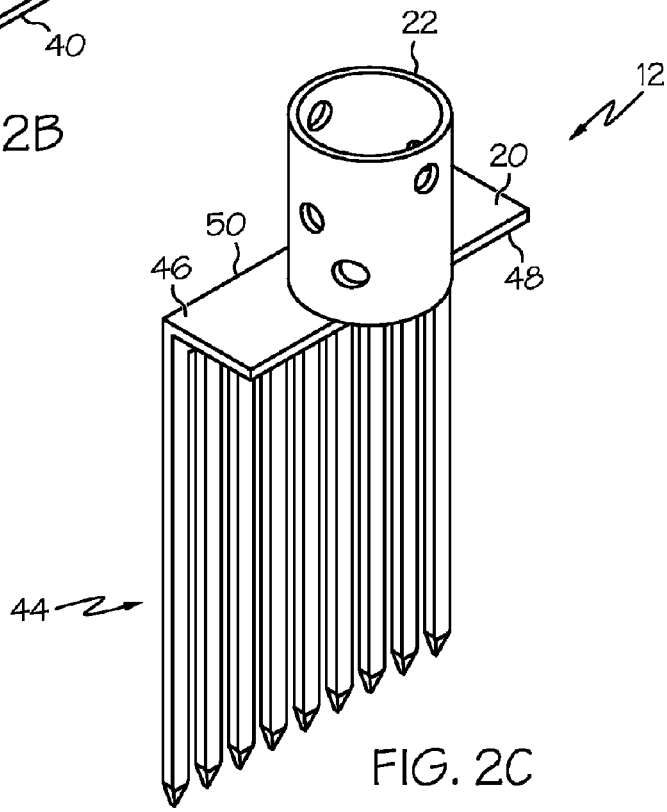
FIG. 2C is a top perspective view of a base assembly of the fixture mounting bracket assembly in accordance with certain embodiments of the present invention.

Now turning to FIGS. 2A-C, certain non-limiting embodiments of base assembly 12 are shown. Generally, base assembly 12 includes a base 20 and a support member 22. FIG. 2A shows an embodiment of base assembly 12 wherein base 20 includes a top surface 24, a bottom surface 26, a front surface 28, a back surface 30. Top and bottom surfaces 24 and 26 define at least one aperture 32 therethrough. Front surface 28 of base assembly 12 of this embodiment may be beveled as shown in FIG. 2A. In certain embodiments, support member 22 may be an arm that is integral with or coupled to top surface 24 of base 20 and is orientated generally perpendicular to and extends away from top surface 24. Generally, aperture 32 is configured to receive a fastener for coupling base assembly 12 to a wall. Alternatively, base 20 may include two apertures 32, one on either side of support member 22, as shown in FIGS. 2A and 2B. One skilled in the art will appreciate apertures 32 may be positioned anywhere suitable on base 20 providing a sufficient load capacity to support a fixture.

FIG. 2B shows an alternate embodiment of base 20 wherein base 20 has a general "L-shape" cross section including a vertical leg 34 and a horizontal leg 36. At least one aperture 32 may be defined through one of legs 34 or 36 or may be defined through abutting edges of legs 34 and 36 as shown in the figure. Horizontal leg 36 includes a top face 38 and a bottom face 40. In this embodiment, support member 22 is integral with or coupled to top face 38 of horizontal leg 36 of base 20 and is orientated generally perpendicular to and extends away from top face 38 of horizontal leg 36.

FIG. 2C shows another embodiment of base 20 wherein base 20 includes a top face 46, a bottom face 48, a back edge 50 and teeth 44 extending generally perpendicular to and downwardly from bottom face 48 of base 20 proximate back edge 50. Further, in this embodiment, support member 22 is a sleeve that is integral with or coupled to base 20 and extends generally upwardly and perpendicularly to top face 46 of base 20.

Generally, base 20 will have dimensions to meet load or aesthetic appearance requirements. In one embodiment, bottom surface 26 of base 20 has a short dimension of about ¾ inches, a long dimension of about 3¼ inches, and a height dimension of about ¾ inches. However, one skilled in the art will appreciate that base 20 may be any dimension that allows fixture mounting bracket assembly 10 to support a fixture from a wall. Further, support member 22 is generally positioned centrally within the extents of base 20 as shown in FIGS. 2A and 2B. One skilled in the art, however, will appreciate that support member 22 may be located in any suitable positions.

Figure 3A:
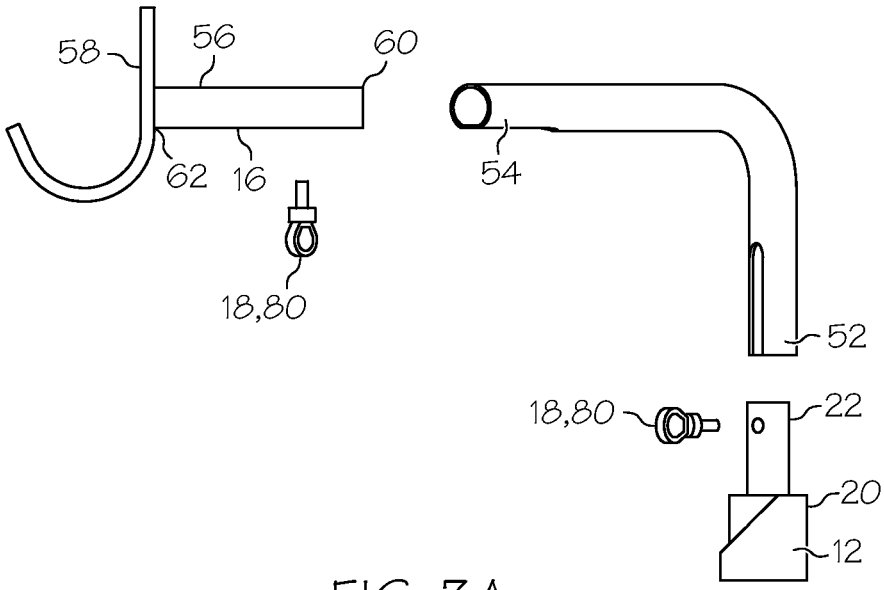
FIG. 3A is an exploded side view of a fixture mounting bracket assembly configured in accordance with certain embodiments of the present invention.
Figure 3B:
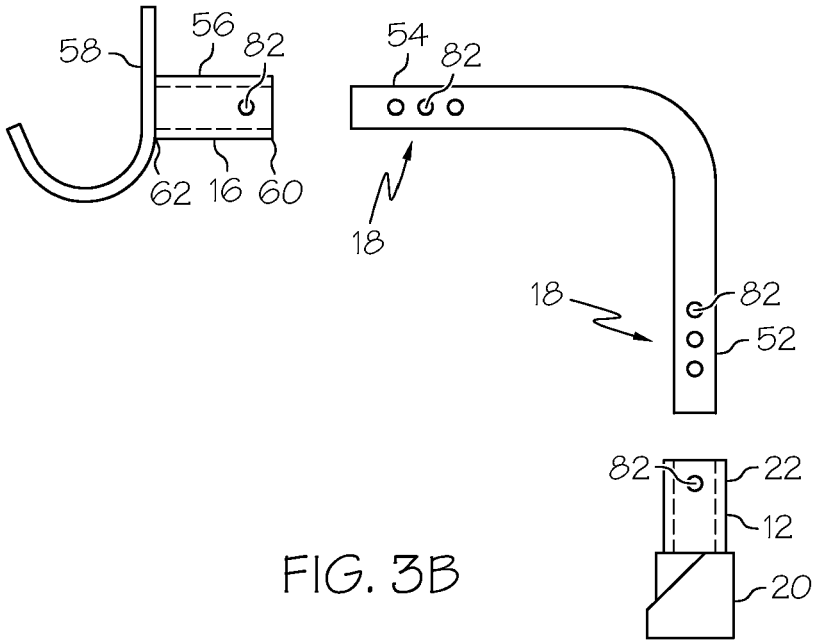
FIG. 3B is an exploded side view of a fixture mounting bracket assembly configured in accordance with certain embodiments of the present invention.

Now turning to FIGS. 3A and 3B, elbow 14 is shown with a generally cylindrical cross-section; however, it will be appreciated by a person in the art that elbow 14 may be any cross-section known in the art that provides sufficient rigidity for fixture mounting bracket assembly 10 to support a fixture, including but not limited to, rectangular or triangular. Further, elbow 14 may be a generally hollow tube or a generally solid rod or bar. Elbow 14 may also be configured to "break away" upon a predetermined force being applied to elbow 14. This break away feature protects interior or exterior finishes by allowing elbow 14 to fail at a predetermined force before damage to walls, moldings, or other finishes occurs.

Elbow 14 has a first end 52 and a second end 54. FIG. 3A shows one embodiment wherein first end 52 is configured to telescopically receives at least a portion of support member 22 wherein first end 52 of elbow 14 is adjustably fixed to support member 22 by adjustment mechanism 18. Alternatively, first end 52 is telescopically received by support member 22 and is adjustably fixed to support member 22 by adjustment mechanism 18 as shown in FIG. 3B. Generally, first end 52 and support member 22 can be coupled together in at least two relative positions.

In addition, elbow 14 may include a short arm and a long arm. In the embodiment shown in FIGS. 3A and *b*, the short arm includes first end 52 and the long arm includes second end 54. This embodiment also provides an alternate orientation of elbow 14 wherein second end 54 of the long end receives or is received by support member 22 in place of first end 52 of the short end. These alternate orientations of elbow 14 allow fixture mounting bracket assembly 10 to be adjustable between two basic configurations from which additional adjustability may be achieved.

Fixture support assembly 16 includes arm 56 and a fixture support member 58. Arm 56 includes a first end 60 and a second end 62. Arm 56 is shown with a generally cylindrical cross section; however, it will be appreciated by a person in the art that arm 56 may be any cross section known in the art that provides sufficient rigidity for fixture mounting bracket assembly 10 to support a fixture, including but not limited to, rectangular or triangular. Further, arm 56 may be a generally hollow tube or a generally solid rod or bar. Arm 56 may be generally straight as shown in FIG. 3 or may be skewed as shown in FIG. 1. In the embodiment shown in FIG. 3A, second end 54 of elbow 14 telescopically receives first end 60 of arm 56 wherein first end 60 of arm 56 is adjustably fixed in relation to second end 54 of elbow 14 by adjustment mechanism 18. In an alternative embodiment shown in FIG. 3B, second end 54 of elbow 14 is telescopically received by first end 60 of arm 56 wherein first end 60 of arm 56 is adjustably fixed to second end 54 of elbow 14 by adjustment mechanism 18. Generally, first end 60 of arm 56 and second end 54 of elbow 14 may be coupled in at least two relative positions.

Fixture support member 58 generally is configured to support the fixture intended to be supported by fixture mounting bracket assembly 10. Fixture support member 58 is rotationally adjustably fixed to second end 62 of arm 56. One embodiment of the present invention includes fixture support member 58 being screwed to second end 62 wherein second end 62 is configured to receive the screw. One skilled in the art will appreciate that any suitable coupling means providing rotational adjustment of fixture support member 58 in relation to second end 62 is within the scope of the present invention. In another embodiment, fixture support member 58 may be a hook as shown in FIGS. 3A and *b* that supports fixtures such as curtain rods, towel rods, plants, signs, banners, artwork, light fixtures, decorations and any other fixture suitable to be supported by a hook. The hook shown in FIGS. 3A and 3B may be of a size to hold curtain rods varying in diameter from about ½ inch to 3 inches; however, one skilled in the art will appreciate that the size of the fixture does not limit the dimensions of fixture support member 58. Alternatively, fixture support member 58 may be any shape, size or material necessary to support fixtures including, but not limited to: curtains, curtain rods, window blinds, window shades, speakers, shelves, tapestries, soap dispensers, towel rods, shower curtain rods, lights, decorations, or any other fixture known in the art that is suitable to be supported by the present invention. In a certain embodiment, fixture support member 58 may include a securing mechanism, such as a set screw (not shown), that prevents a fixture from being undesirably removed from fixture support member 58.

Adjustment mechanism 18 generally fixes elbow 14 relative to support member 22 of base assembly 12 and arm 56 of fixture support assembly 16 to elbow 14. Adjustment mechanism 18 allows elbow 14 and support member 22 of base assembly 12 to be telescopically adjusted to at least two different fixed relative positions. Further, adjustment mechanism 18 provides elbow 14 and arm 56 of fixture support assembly 16 to be telescopically adjusted to at least two different fixed relative positions. In addition to telescopic adjustment, adjustment mechanism 18 may allow for rotational movement between elbow 14 and support member 22 as well as elbow 14 and arm 56. FIG. 3A shows an embodiment of adjustment mechanism 18 wherein ends 52 and 54 of elbow 14 are slotted and a set screw 80 is threaded through support member 22 and arm 56 of fixture support assembly 16 proximate first end 60 of arm 56. Support member 22 and arm 56 may be telescopically adjusted relative to elbow 14 and the relative position of elbow 14 to support member 22 and arm 56 is fixed by tightening the set screw 80.

FIG. 3B shows an embodiment of adjustment mechanism 18 wherein at least two holes 82 are present in ends 52 and 54 of elbow 14 and support member 22 and arm 56 have at least one hole 82. Both support member 22 and arm 56 receive elbow 14. Elbow 14 is telescopically adjusted relative to both support member 22 and arm 56 such that one hole 82 proximate first end 52 of elbow 14 lines up with hole 82 of support member 22 and one hole 82 proximate second end 54 of elbow 14 lines up with thru-hole 82 of arm 56 wherein the configuration of holes 82 provides at least two fixed relative positions of elbow 14 and support member 22 and at least two fixed relative positions of elbow 14 and arm 56 as shown in FIG. 3B. A pin, bolt, screw or other suitable fastener known in the art is then inserted through thru-holes 82 and engages both members 12 and 14 or 14 and 56 to fix elbow 14 relative to support member 22 and fix elbow 14 relative to arm 56. One skilled in the art would appreciate that adjustment mechanism 18 is not limited to the described embodiments and can be any suitable securing mechanism known in the art such as a clamp, a collar, or a compression fitting.

Figure 4:
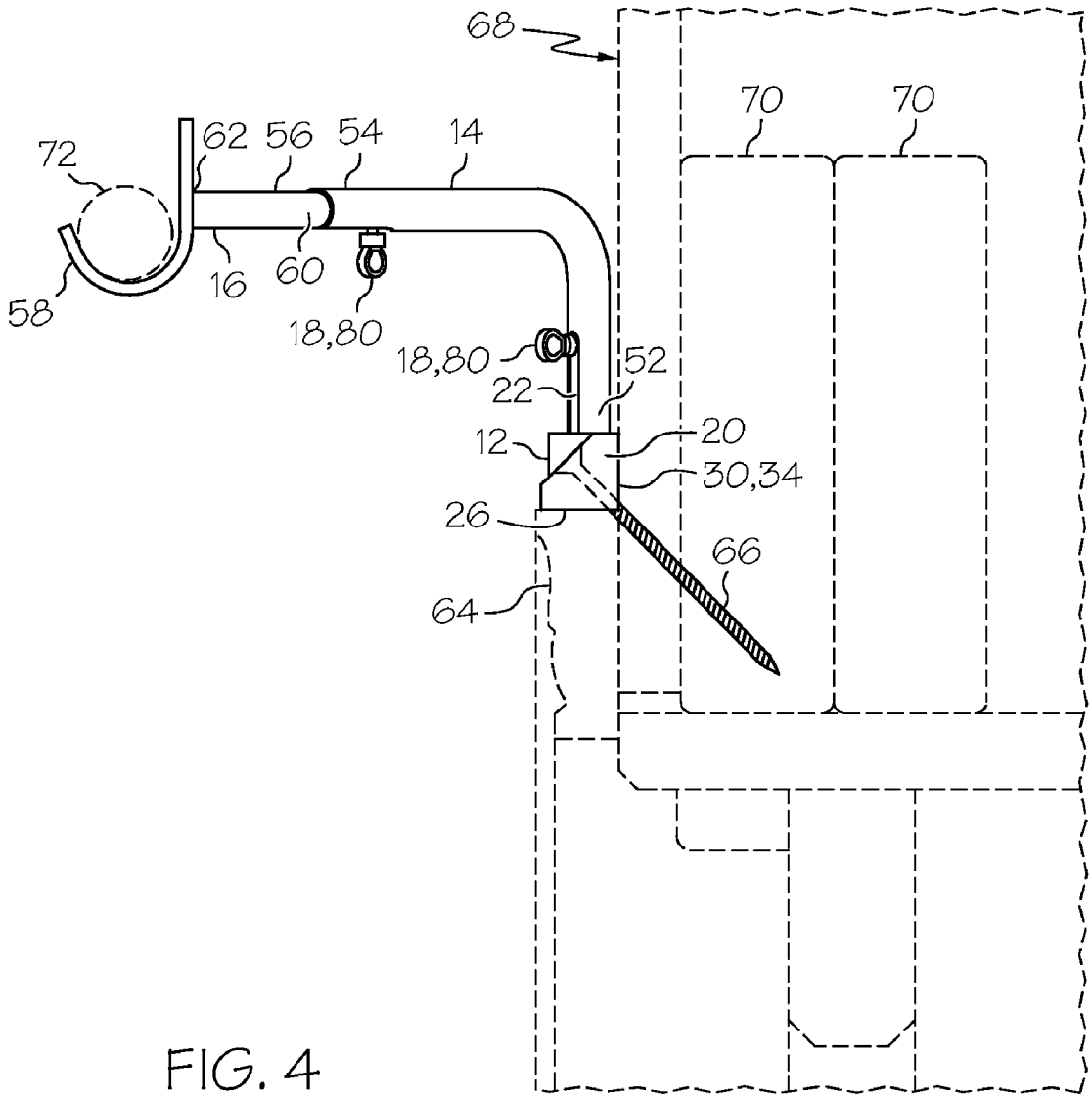
FIG. 4 is a side sectional view of a fixture mounting bracket assembly configured in accordance with certain embodiments of the present invention as installed on a wall wherein the wall is shown in section.
Figure 5:
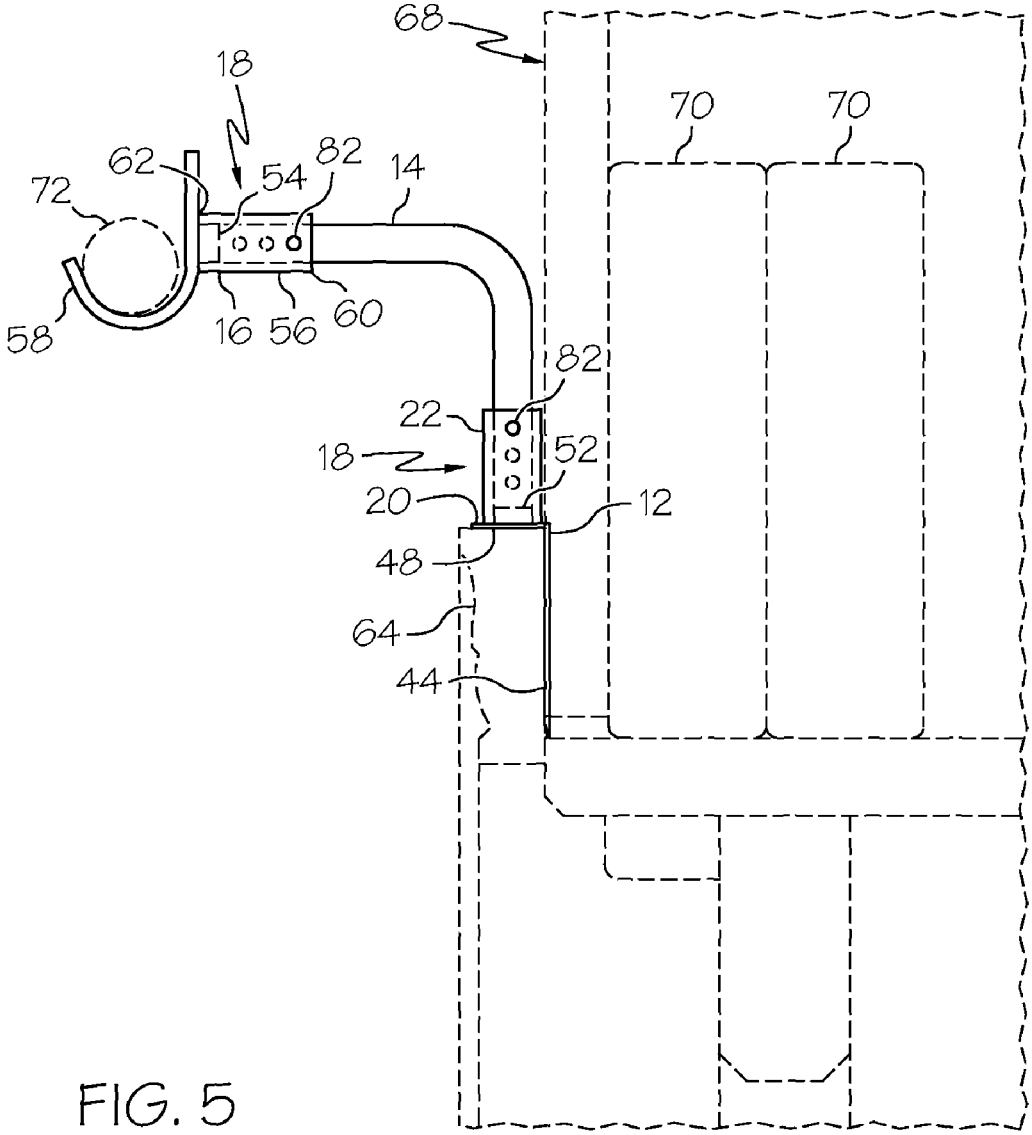
FIG. 5 is a side sectional view of a fixture mounting bracket assembly configured in accordance with certain embodiments of the present invention as installed on a wall wherein the wall is shown in section.

In use, fixture mounting bracket assembly 10 is installed on a ledge member 64 adjacent a wall 70 as shown in FIGS. 4 and 5. Ledge member 64 may be any area in which two generally flat surfaces meet including, but not limited to, the exterior or interior of a door or window, door or window trim molding, walls and corners thereof, crown molding, the area in which a wall meets a ceiling, chair rail, picture rail, shelving, wainscoting, a sink or counter back splash, or any other suitable ledge in a commercial or residential setting. FIGS. 4 and 5 show fixture mounting bracket assembly 10 installed on the top of a horizontally-orientated window trim molding 64. Fixture mounting bracket assembly 10 may alternatively be installed on a vertically-orientated ledge member 64. FIG. 4 shows fixture mounting bracket assembly 10 being positioned such that the entire bottom surface 26 or bottom face 40 of base 20 bear on ledge member 64 and back surface 30 or vertical leg 34 of base 20 rest against wall 70. Fixture mounting bracket assembly 10 is generally self-leveling upon the entire bottom surface 26 or bottom face 40 bearing on ledge member 64. Base assembly 12 as shown in FIG. 2A or 2B is secured to wall 68 using a fastener 66 driven into wall studs 70 at about a forty-five (45) degree angle.

Driving fastener 66 into wall studs 70 at about a forty-five (45) degree angle allows the holes in the wall 68 created by mounting fixture mounting bracket assembly 10 to be substantially unseen when ledge member 64 is above eye-level. Further, driving fastener 66 into wall studs 70 at about a forty-five (45) degree angle creates holes in wall 70 and ledge member 64 that are at the joint of ledge member 64 and wall 70 and are easily concealed and repaired. FIG. 4 shows fastener 66 as a screw; however, it will be appreciated by one skilled in the art that fastener 66 may be any suitable fastener including, but not limited to nails, lag bolts, masonry screw anchors, concrete screw anchors, adhesives, or drywall anchors. In certain embodiments, fastener 66 may also be a magnet or the like for mounting fixture bracket assembly 10 to a steel stud or the like in wall 70 such that no holes need be created in wall 70 whatsoever.

Alternatively, FIG. 5 shows base assembly 12 shown in FIG. 2C wherein no fastener 66 is required. Teeth 44 of base assembly 12 are driven between wall 68 and ledge member 64 using a hammer or the like. It will be appreciated by one skilled in the art that the driver is not limited to a hammer, but any other driver known in the art may also be utilized. Teeth 44 and spaces between teeth 44 allow the base assembly 12 to be secured regardless of the pattern of finishing fasteners (usually nails) used to couple ledge member 64 to wall 68. Again, base assembly 12 is generally self-leveling when teeth 44 are fully driven between ledge member 64 and wall 68 and the entire bottom face 48 of base 20 bears on ledge member 64.

Once base assembly 12 is secured to wall 68, first end 52 of elbow 14 either receives or is received by support member 22. Adjustment mechanism 18 allows elbow 14 and support member 22 to be telescopically adjusted and fixed at a desired relative position. FIG. 4 shows adjustment mechanism 18 being set screw 80. FIG. 5 shows adjustment mechanism 18 being multiple holes 82 and a pin or other suitable fastener. FIGS. 4 and 5 show embodiments of fixture mounting bracket assembly 10 being installed on a horizontal ledge member 64. Installed in this orientation, elbow 14 will be telescopically adjusted in a vertical direction in relation to base assembly 12 such that elbow 14 is fixed by adjustment mechanism 18 at a desired vertical position.

Next, second end 54 of elbow 14 either receives or is received by arm 56 of fixture support assembly 16. Adjustment mechanism 18 allows elbow 14 and arm 56 to be telescopically adjusted and fixed at a certain relative position. FIG. 4 shows adjustment mechanism 18 being a set screw 80. FIG. 5 shows adjustment mechanism 18 being multiple thru-holes 82 and a pin or other suitable known fastener in the art. FIGS. 4 and 5 show embodiments of fixture mounting bracket assembly 10 being installed on a horizontal ledge member 64. Installed in this orientation, arm 56 may be telescopically adjusted in a horizontal direction generally away from wall 68 relative to elbow 14 such that fixture support assembly 16 is fixed by adjustment mechanism 18 at a desired distance away from wall 68.

Figure 6:
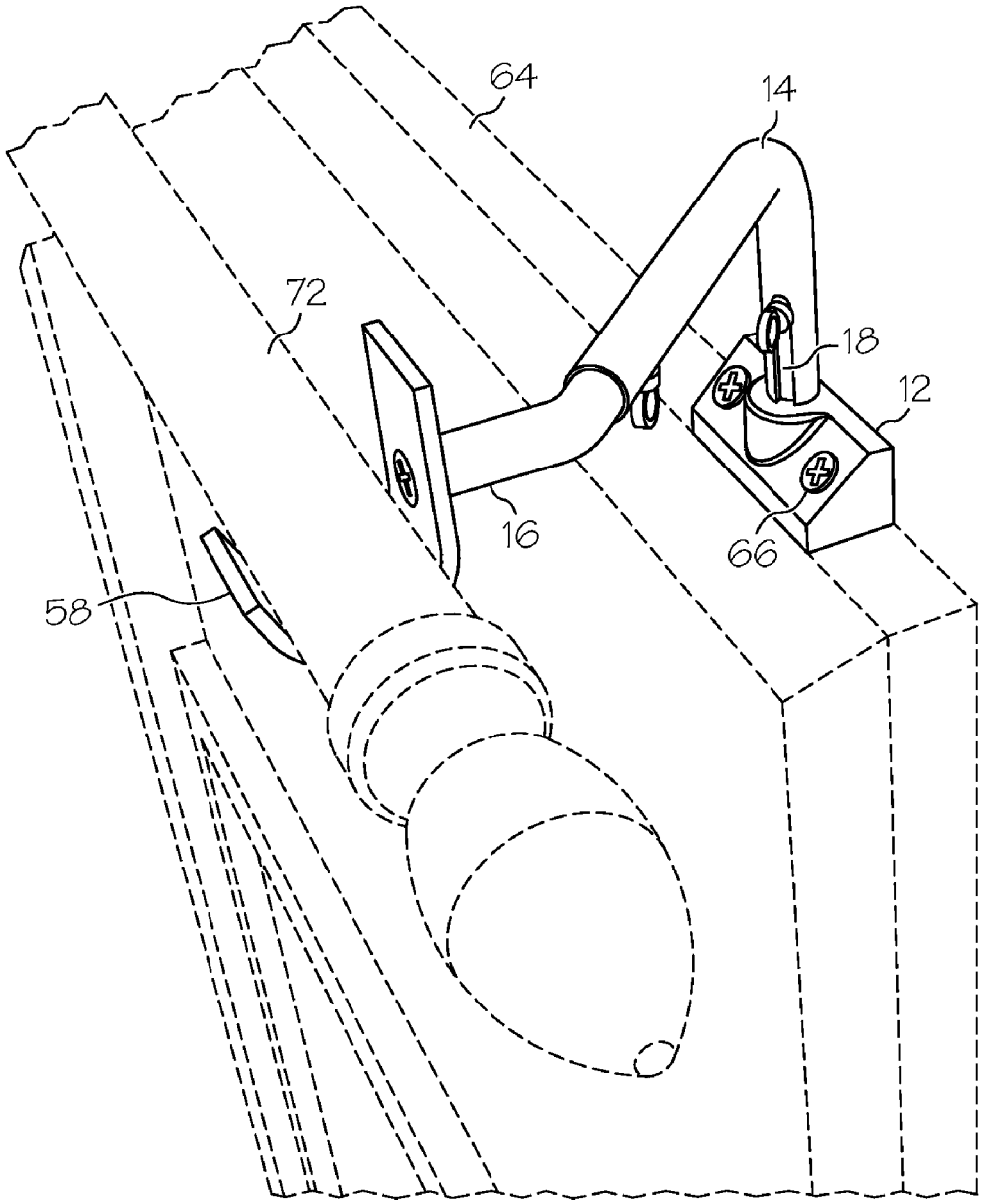
FIG. 6 is a top perspective view of a fixture mounting bracket assembly configured in accordance with certain embodiments of the present invention as installed and in use.

Finally, turning to FIG. 6, fixture support member 58 is configured to support fixture 72. In this embodiment, fixture support member 58 is a hook and fixture 72 is a curtain rod that bears upon the hook 58. Multiple fixture mounting bracket assemblies 10 may be installed by repeating this process to mount additional fixture mounting bracket assemblies 10 on wall 66 and ledge member 64 as required to adequately support fixture 72. For example, fixtures 72 such as shelves and curtain rods will generally require more than one fixture mounting bracket assembly 10.

I claim:

1. A bracket assembly for mounting a fixture on a wall comprising:

a base assembly directly attached to a wall in order to mount the bracket assembly thereon;

a connecting part coupled to the base assembly;

a fixture support assembly coupled to the connecting part; and at least two adjustment mechanisms positioned between the fixture support assembly and the base assembly, said at least two adjustment mechanisms and the connecting part together allowing the base assembly to be positioned in a different plane from the fixture support assembly so that the fixture support assembly is positioned out of perpendicular alignment with the base assembly;

wherein said base assembly is adjustably fixed relative to said connecting part with at least one of said adjustment mechanisms and said connecting part is adjustably fixed relative to said fixture support assembly with at least one of said adjustment mechanisms.

2. The bracket assembly of claim 1 wherein said bracket assembly is constructed of a material selected from the group consisting of metal, plastic, ceramic and wood.

3. The bracket assembly of claim 1 wherein said bracket assembly is adjustably fixed in at least two horizontal positions, at least two vertical positions, and at least two transverse positions, and the at least two adjustment mechanisms allow for rotation of the connecting part relative to one or more of the fixture support assembly and the base assembly in order to position the fixture support assembly out of alignment with the base assembly.

4. The bracket assembly of claim 1 wherein said base assembly includes a base and a base support member wherein said base has a top surface and a bottom surface wherein said base support member is coupled to said top surface of said base.

5. The bracket assembly of claim 4 wherein said connecting part includes a first end and a second end and said fixture support assembly includes an arm and a fixture support member wherein said base support member telescopically receives or is received by said first end of said connecting part and said second end of said connecting part telescopically receives or is received by said arm.

6. The bracket assembly of claim 5 wherein said fixture support member is a hook.

7. The bracket assembly of claim 1 wherein said base assembly is coupled to a wall with a fastener wherein said fastener lies in a plane at about a forty-five degree angle with respect to said wall.

8. The bracket assembly of claim 1 wherein said connecting part is an elbow that has a short side and a long side wherein said short side and said long side are interchangeable.

9. The bracket assembly of claim 1 wherein at least one of the two adjustment mechanisms includes a set screw and said connecting part includes a slot configured to slidably receive at least a portion of said set screw.

10. The bracket assembly of claim 1 wherein at least one of said two adjustment mechanisms includes a pin and a hole defined through said connecting part and configured to receive said pin.

11. The bracket assembly of claim 1 wherein at least one of said two adjustment mechanisms allows for rotational adjustment.

12. A bracket assembly for mounting a fixture on a wall comprising:

a substantially load-bearing base member having a first abutting surface and a second abutting surface, and at least one aperture defined therethrough;

wherein said aperture receives a fastener at an angle of incidence with respect to said wall, with said aperture having an entrance opening for receiving a fastener on an outer surface of the base member and an exit opening that is substantially in an area where the first and second abutting surfaces meet; and wherein said base member is removably coupled to a wall in a vertical or horizontal orientation such that one of said abutting surfaces of said base member bears upon a ledge or rests generally flush against a wall and another of said first or second abutting surfaces of said base member is generally flush with an adjoining surface.

13. The bracket assembly of claim 12, wherein the abutting surfaces are defined at a location where trim meets a wall, a ceiling meets a wall, or a wall meets a wall, and further comprising:

a support member extending from said base member configured to support the fixture, and the angle of incidence of said aperture with respect to said wall is acute.

14. The bracket assembly of claim 12, further comprising a fastener that is configured to be coupled to a wall stud.

15. An apparatus for mounting a fixture on a wall structure having a first plane and a second intersecting plane so as to not mar a surface of trim that is coupled to the wall structure, comprising:

a mounting bracket assembly for association with a fixture;

the mounting bracket assembly including a base having first and second base surfaces that seat the base in an installed position in which the first base surface abuts the first plane and the second base surface abuts the second plane;

the base further having at least one aperture extending therethrough that locates an entry point for a fastener through the base and into the wall structure at an acute angle to the first plane when the base is in the installed position such that when a fastener is inserted into the aperture to couple the base to the wall structure, a surface of any trim of the wall structure is not marred; and further comprising a fastener configured to extend through the at least one aperture and into the wall structure to a depth behind the first plane, wherein the at least one aperture is configured to guide the fastener to penetrate the wall structure substantially at an intersection of the first plane and the intersecting second plane.

16. An apparatus for mounting a fixture on a wall structure having a first plane and a second intersecting plane so as to not mar a surface of trim that is coupled to the wall structure, comprising:

a mounting bracket assembly for association with a fixture;

the mounting bracket assembly including a base having first and second base surfaces that seat the base in an installed position in which the first base surface abuts the first plane and the second base surface abuts the second plane; and the base further having at least one aperture extending therethrough that locates an entry point for a fastener through the base and into the wall structure at an acute angle to the first plane when the base is in the installed position such that when a fastener is inserted into the aperture to couple the base to the wall structure, a surface of any trim of the wall structure is not marred, wherein the mounting bracket assembly includes a support member fixed to the base and a fixture support assembly releasably and adjustably attached to the support member.

17. An apparatus as defined in claim 16, wherein the fixture support assembly is telescopically adjustable.

18. An apparatus for mounting a fixture on a wall having a first plane, a second plane that is different from the first plane and that is positioned at an angle relative to to the first plane, and framing behind the first or second plane, comprising:

a mounting bracket assembly;

the mounting bracket assembly including a base having a first surface and a second surface configured to seat the base in an installed position in which the first surface rests against one of the first plane or the second plane and the second surface rests against the other of the first and second planes, said base including an aperture for locating an opening for a fastener to securely fasten the base to a wall, said aperture extending from an opening defined on a fixture receiving surface of the base member to an exit positioned substantially in an area where the first surface meets the second surface.

19. An apparatus as defined in claim 18, wherein the aperture is at an inclined angle to the first or second plane that is one of downwardly inclined, upwardly inclined, or transversely inclined at about 45 degrees.

20. An apparatus as defined in claim 19, wherein the mounting bracket assembly includes a support member fixed to the base for supporting a fixture and the fixture support member is adjustable.

21. The bracket assembly of claim 1, wherein at least one of the connecting part or the fixture support assembly is configured to break away from the base assembly upon the application of a predetermined force being applied to said connecting part, wherein said predetermined force is lower than a force necessary to pull the base assembly away from the wall.

22. An apparatus for mounting a fixture on a wall having a first plane, a second plane that is different from the first plane and that is positioned at an angle relative to the first plane, and framing behind the first or second plane, comprising:

a mounting bracket assembly that has a base member with a first surface and a second surface configured to seat the base in an installed position in which the first surface rests against one of the first plane or the second plane and the second surface rests against the other of the first and second planes, said base member including an aperture for locating an entry point for a fastener to securely fasten the base to the framing behind the first or second plane, said aperture extending from an opening defined on a fixture receiving surface of the base member to an exit opposite said fixture receiving surface, with the exit being positioned substantially in an area where the first and second surfaces meet.

* * * * *